United States Patent [19]

Cramer

[11] 4,050,904

[45] Sept. 27, 1977

[54] SOLUBILIZATION AND REACTION OF COAL AND LIKE CARBONACEOUS FEEDSTOCKS TO HYDROCARBONS AND APPARATUS THEREFOR

[75] Inventor: Frank B. Cramer, Mission Hills, Calif.

[73] Assignee: Clean Energy Corporation, Los Angeles, Calif.

[21] Appl. No.: 644,953

[22] Filed: Dec. 29, 1975

Related U.S. Application Data

[62] Division of Ser. No. 512,538, Oct. 7, 1974, Pat. No. 3,966,582.

[51] Int. Cl.[2] ..... B01J 1/00

[52] U.S. Cl. ..... 23/288 E; 23/285

[58] Field of Search ..... 23/288 E, 283, 284, 23/285; 48/73, 99, 202; 165/111, 169, 170

[56] References Cited

U.S. PATENT DOCUMENTS

| | | | |
|---|---|---|---|
| 2,703,275 | 3/1955 | Elliott et al. | 48/73 X |
| 2,768,935 | 10/1956 | Watkins | 23/288 E X |
| 2,890,929 | 6/1959 | Rummert | 23/284 X |
| 3,105,778 | 10/1963 | Anderson | 23/285 X |
| 3,505,018 | 4/1970 | Bawa et al. | 23/284 X |
| 3,668,109 | 6/1972 | Kiovsky et al. | 208/10 |
| 3,708,270 | 1/1973 | Birk et al. | 48/202 |
| 3,745,109 | 7/1973 | Heredy et al. | 48/210 X |
| 3,849,075 | 11/1974 | Albright et al. | 23/284 |

*Primary Examiner*—Joseph Scovronek
*Attorney, Agent, or Firm*—Louis J. Bachand

[57] ABSTRACT

Apparatus for effecting an hydrogenation of e.g. bituminous coal in dissolved state in molten inorganic salts with active hydrogen derived in situ from dissociated steam and recovery of hydrocarbon vapor products sequentially evolved throughout the reaction zone by progressively stripping later evolved vapors with earlier evolved vapors passed differentially through the reaction stream.

4 Claims, 4 Drawing Figures

SOLUBILIZATION AND REACTION OF COAL AND LIKE CARBONACEOUS FEEDSTOCKS TO HYDROCARBONS AND APPARATUS THEREFOR

This is a division of my earlier application, Ser. No. 512,538, filed Oct. 7, 1974, now U.S. Pat. No. 3,966,582 issued by June 29, 1976.

BACKGROUND OF THE INVENTION

This invention has to do with process and apparatus for the generation and recovery of low molecular weight hydrocarbons e.g., $C_1$ to $C_{20}$ from high molecular weight carbonaceous materials such as coal, particularly bituminous, sub-bituminous and lignite orders of coal, i.e. sub-anthracite coals, and other carbonaceous feedstocks particularly those having an average molecular weight of 2000 and more.

More particularly, the invention relates to a relatively low temperature processing of such feedstocks to effect without substantial pyrolysis the conversion thereof to low molecular weight hydrocarbons. Important aspects of the process include substantial absence of pyrolysis, as just noted, which heretofore has limited certain coal treating processes to the production of carbon oxides and very high molecular weight carbocyclic char; lower reaction temperatures i.e., below 600° C and particularly below 500° C, very short reaction e.g. less than 10 seconds residence time at lowest temperatures used and generally from as little as 0.2 seconds to about 5 seconds; use of inorganic molten salts as a reaction stream matrix, a catalyst to facilitate lower temperature reaction and a heat transfer medium; presolubilization of feedstock in the molten salt solvent at temperatures limiting or eliminating outgassing which has heretofore restricted solublization and achievement of homogeneous, solution reaction of coals; progressive scrubbing or stripping of evolved hydrocarbon vapors by earlier evolved vapors to coalesce and collect said vapors for recovery by differential passage of the vapors through the reaction stream; generation in situ of a non-molecular, active form of hydrogen by dissociation of steam in the molten salt; and progressive formation of hydrocarbon products in laminarly related reaction stream lines and the stripping of vapor product therefrom by transport of hydrocarbon across adjacent stream line interfaces; and apparatus for effecting the foregoing including especially a discoid reactor adapted to the differential spiral movement of reaction stream and product vapors.

PRIOR ART

The more effective utilization of carbonaceous high molecular weight e.g. solid fuels has long been sought as the answer to imposed or real shortages of oil and natural gas for fuel and raw material use. The present invention is particularly adapted to utilization of subanthracite coal for production of chemicals e.g. $C_1$ to $C_{20}$ hydrocarbons and in the ensuing description frequent reference will be made to coal, by which I mean substantially subanthracite coal, as illustrative of preferred reactants in the process.

The pace of carbonaceous solid fuel research, primarily regarding subanthracite coal has been quickened of late with the objective of using the vast reserves of such material within the continental United States. Like few comparable undertakings, the research into conversion of such coal has been thorough with virtually every avenue explored; the literature is extensive and complex, but the definition of the ultimate economic system for coal use has proved elusive.

In general, the effort to utilize carbonaceous solid fuels has been directed to some substantial degree to chemicals production, e.g. primarily synthesis gas (CO and $H_2$) which may then be combined into various organic chemicals, or synthetic natural gas, i.e. methane ($CH_4$) for use as heating fuel, and some hydrocarbons above methane. In each case, the sulfur content of typical coal has been a problem and low sulfur oils and naphthas have been considered as more desirable alternate fuels to these plants; but these feedstocks are subject to governmental allocations.

There have been efforts made to treat coal to remove sulfur an other environmentally harmful constituents of coal either in conjunction with heat producing applications or in connection with attempted chemicals production. See for example USP No. 3,779,722 to Tatum. There have been long continued, albeit sporadic efforts to obtain the carbon chain values of coal, i.e. the straight or cyclic chains of $C_2$ to $C_{20}$ molecules, rather then merely carbon oxides (CO, $CO_2$) which result from complete oxidation of the coal. Indeed it is generally acknowledged that coal is a more promising source of carbon chain molecules than oil. Most attempts at carbon chain derivatives from coal have been concentrated on destruction of the coal moleculer and capture of the fragments of interest. Hydrogen needs to be added to stabilize the fragments against recombination as the naturally occurring carbon to carbon bonds (C —C) are broken. This addition has been accomplished with hydrogen per se and with steam which dissociates at reaction conditions to provide an active, non-molecular form of hydrogen which attaches to the broken carbon bond, converting or completing the coal fragment into a stable hydrocarbon, which may be saturated or unsaturated, aliphatic, alicyclic, aromatic or a heterocyclic molecule depending on the particular coal and fragment converted.

The recovery of the produced hydrocarbon and the utilization of the unconverted coal or residuum has been sought in certain of these previously published efforts, e.g. the COED system.

A leading difficulty in adopting previously disclosed processes for coal treatment has been the lack of adequate rates of conversion to hydrocarbon and production of mainly pyrolysis products e.g. carbon oxides and char rather than longer chain aliphatic and mono- up to tricyclic aromatics.

SUMMARY OF THE INVENTION

OBJECTS OF THE INVENTION

The objects of the invention include production of hydrocarbon and related chemicals e.g. hydroxyl, carbonyl, and carboxyl substituted derivatives from carbonaceous feedstocks primarily subanthracite coal, but also from coal tars, heavy aromatic petroleums residues, pitch, and coal extracts and like carbon bearing i.e. carbonaceous materials which are combustible and thus may be classified as fuels. Other objects include effecting reactions at lower temperatures to preserve the carbon chains and avoid pyrolysis; use of molten salt for its catalytic effect but in quantities such that the salt is a solvent, reaction matrix and heat transfer medium; driving the reaction to near completion by ejection and removal of product hydrocarbons and scavenging the reaction mass for product vapors and gases cumulatively to ensure complete separation of the materials of interest.

Other objects will appear as the description proceeds.

GENERAL SUMMARY

In accordance with the invention the foregoing and the other objects of the invention are realized by the process for the generation and recovery of low molecular weight hydrocarbons from high molecular weight carbonaceous feedstock which includes passing through a reaction zone a reaction stream comprising an inorganic molten salt solution of the feedstock and active hydrogen in a manner briefly contacting the feedstock with the active hydrogen under mild hydrogenating conditions, to produce low molecular weight hydrocarbon vapors dispersed through the reaction stream, and collecting and recovering the vapors differentially from the reaction stream.

As used herein, the term "differentially" as applied to movement of the hydrocarbon vapors is related to driving the carbonaceous feedstock conversion to substantial completion in the kinetic sense, and indicates the movement of the vapor bubbles as they evolve differently but with like vectors through the reaction stream mass and to the relative movements of the several vapor bubbles, the rate of any one of which is a function of the relative volatility of the hydrocarbon of which it is composed, so that earlier evolved, relatively lighter molecular weight hydrocarbon vapors e.g. $C_1$ to $C_6$ will move relatively more rapidly than and thus overtake later evoved, relatively heavier molecular weight hydrocarbon vapors e.g. $C_{14}$ to $C_{20}$ and as to these bubbles of vapor then there is differential movement between them, and between each bubble and the reaction stream at the same time as well.

The process further contemplates effecting the reaction zone contacting step under adiabatic conditions, generating the active hydrogen in situ in the reaction stream by dissociation of steam within the reaction zone, employment of a reaction stream containing the molten inorganic salt in an amount not less than twice the weight of feedstock in the reaction stream, maintaining temperatures between 250° and 600° C in the reaction stream within the reaction zone, using residence times (defined as reaction zone volume divided by reaction mass flow rate through the reactor) of not more than 10 seconds and generally on the order of 0.2 to about 5 seconds, converting from 50 to 85% by weight of the feedstock to hydrocarbon vapor or gases in the reaction zone, recovering $C_1$ to $C_{20}$ hydrocarbon vapor from the reaction zone, to condensing the hydrocarbons.

Preliminary to the aforementioned reactions the invention process may utilize admixing of the feedstock particularly the solid carbonaceous fuels such as coal with molten salt in advance of the reaction zone, passing the fuel and molten salt together between interfitting plural surfaces of rotation in an admixing zone, metering the fuel and molten salt into the admixing zone in a manner sealing the admixing zone from the fuel and molten salt supplies, pretreating the feedstock where it is coal to reduce the particle size thereof e.g. to a size to pass a No. 8 Tyler sieve in advance of admixing with molten salt; and recycling the molten salt to and from the reaction zone with continual additions of fresh feedstock.

PREFERRED EMBODIMENTS SUMMARY

In more particularly preferred embodiments, the invention comprises the process for the generation and recovery of $C_1$ to $C_{20}$ low molecular weight hydrocarbons from substantially higher molecular weight carbonaceous feedstocks, which includes combining into a reaction stream at a temperature below about 500° C an inorganic molten salt solution of the feedstock and steam derived active hydrogen, passing said reaction stream through a reaction zone in a manner briefly contacting the feedstock with the active hydrogen to produce undissolved hydrocarbons vapor in the reaction stream, and differentially collecting and recovering the vapors.

Typically, the hydrocarbons vapors are produced initially sequentially within the reaction stream in approximately the order of their increasing molecular weight, with hydrocarbons vapors first generated within the reaction stream being passed differentially therethrough in scrubbing relation to later generated vapors within the reaction stream. Moreover, the reaction stream is preferably passed progressively and continuously through the reaction zone and the hydrocarbon vapors are produced initially sequentially within the reaction stream in approximately the order of their increasing molecular weight; and the process then further includes passing relatively lower molecular weight hydrocarbon vapors earlier evolved within the reaction stream differentially therethrough in scrubbing relation to progressively coalesce the relatively higher molecular weight hydrocarbon vapors later evolved within the reaction stream with the earlier evolved vapors and during progression of the reaction stream through the reaction zone.

As in earlier embodiments steam may be sparged into the reaction stream under dissociating conditions to generate in situ in the reaction stream the active hydrogen reactant. In preferred cases, the steam to be introduced by sparging into the reaction stream is at relatively lower temperature e.g. 250°-300° C, below the preferred reaction stream temperatures of 300° to 425° C and may be passed along the reaction zone exterior walls in advance of its introduction into the reaction zone.

In one particular embodiment, the reaction stream flows vertically upwardly through said reaction zone and is removed laterally from the upper reaches of the zone and including also collecting the coalesced hydrocarbon vapors in a head space above the upper reaches of the reaction zone. In such embodiment, the reaction stream may be passed as a plurality or laminarly related stream lines through the reaction zone, and the steam source of active hydrogen may be introduced into the plural stream lines.

In another and more particularly preferred embodiment, the reaction zone is discoid in configuration i.e., circular and defining a generally cylindrical, normally horizontally disposed volume, and is adapted to laminar flow of plural stream lines in a generally spiral path through the zone from periphery to center. In this embodiment, the molten salt solution of the feedstock may be introduced tangentially into the discoid reaction zone and the steam distributively introduced thereinto at multiple locations radially inward of the zone periphery to form a progressively inwardly spiraling reaction stream. Further in the discoid zone embodiment, the differential passage of the hydrocarbon vapors through the spiraling reaction stream is along a path of greater spiral pitch than the reaction stream inward to the discoid reaction zone center. The hydrocarbon vapors accordingly may be collected and coalesced centrally above the eye of the reaction stream spiral in the discoid reaction zone.

In the discoid embodiment, the successive turns of the spiraling reaction stream define distinct stream lines and the process further includes passing the evolved hydrocarbon vapors across the interfaces of adjacent stream lines along the vapor greater pitch spiral path and toward the reaction zone center, having inward displacement by virtue of the relatively greater centrifugal moment given the heavier spiraling molten salt while being entrained and carried angularly inward as well by the salt stream lines.

In preferred embodiments as well the molten salt solution may comprise from 5 to 30% by weight subanthracite coal or like carbonaceous feedstock, the reaction zone temperatures may be maintained at between 300° and 425° C and the reaction stream residence times between 0.2 and about 5 seconds and generally the shorter times with the higher reaction stream temperatures in the ranges given. In such preferred embodiments, generally not more than about 15 to 50% by weight of coal or like feedstock is residual in the molten salt following the hydrogenation reactions.

In handling the molten salt as solvent, catalyst and heat transfer medium it is preferred practice to comminute and admix the solid fuel feedstock into solution in the molten salt, without outgassing, by passage through an admixing zone subjecting the salt and e.g. coal to shearing forces between intermeshing plural surfaces of revolution. The salt exiting the reaction zone may be recycled to the admixing zone for fresh feedstock addition, preferably following a purging from the salt solution of the mentioned residual of feedstock e.g. dissolved coal char, therein prior to recycling.

The process further includes techniques for recovery of the separated hydrocarbon vapor including condensing and fractionating by molecular weight these products. For example, these vapors may be expanded and thus cooled to condensation temperatures and pressures progressively through a suitable horn or expander drum to sequentially condense and separate as hydrocarbon fractions.

FURTHER PREFERRED EMBODIMENTS

The further preferred embodiments of the process include process for generation and recovery of $C_1$ to $C_{20}$ low molecular weight hydrocarbons from coal and like carbonaceous feedstocks having an average molecular weight above about 2000, which includes forming a slurry homogenate comprising from 5 to 30 per cent by weight of the feedstock in preheated molten inorganic salt and admixing the feedstock to solution in said salt substantially without outgassing, introducing the feedstock-salt solution at a temperature between about 300° and 425° C into an adiabatic reaction zone at a pressure from 1 to 20 and preferably from 1 to 10 atmospheres, introducing saturation quantities of steam distributively into the solution in the reaction zone under conditions dissociating said steam into active hydrogen, passing the active hydrogen and the feedstock- salt solution through the reaction zone mixed together into a reaction stream at a rate providing an average residence time between about 0.2 and 5 seconds for the reaction stream within the reaction zone, and in a manner reacting the feedstock with hydrogen substantially without pyrolysis and sequentially evolving progressively higher molecular weight hydrocarbon vapor products and passing the hydrocarbon vapors differentially to one another and through the reaction stream to strip higher molecular weight hydrocarbon vapors later evolved from the reaction stream with earlier evolved lower molecular weight hydrocarbon vapors passing relatively more rapidly through the reaction stream and collecting the combined hydrocarbon vapors downstream of the reaction zone, separating spent salt solutions containing from 15 to 50% by weight of the initial charge of feedstock as residual, treating the spent salt solution to remove the residual, and recycling the salt solution with fresh feedstock to the reaction zone. The steam used in this embodiment, too, may be introduced at a relatively lower temperature than that of the feedstock-salt solution within the reaction zone, and may therefore be first passed over the exterior surface of the reaction zone toward its point of introduction to absorb heat emanating from the zone and thereby return emanated heat to the zone.

Apparatus is provided for carrying out the foregoing process for the conversion of coal and like high molecular weight feedstocks at least partially to hydrocarbon vapor, the apparatus comprising a reaction chamber, means to introduce a molten salt solution of the feedstock into the chamber at one location and to remove the solution at another location, means to mix steam continually into fresh portions of the solution under hydrogenating conditions within the chamber, and means to recover evolved hydrocarbon vapors from the chamber. The chamber may be discoid and include a salt solution inlet extending tangentially into the chamber and an outlet adjacent the chamber center, means to distributively introduce steam into the salt solution adjacent the inlet and means to collect evolved hydrocarbon vapors centrally of the chamber. The apparatus may further include an enclosing insulating jacket defining a path for the steam to be introduced into the chamber extending generally from the center of the chamber toward the periphery thereof and terminating adjacent the steam introduction means to the chamber, and support structure for the chamber including plural radially disposed ribs, the insulating jacket and ribs being arranged relatively to insulate the ribs from the heat within the chamber. Additionally, and in highly preferred embodiments, the apparatus may further comprise the discoid chamber having an axially restricted central portion adapted to receive evolved, coalesced hydrocarbon vapor in salt solution-excluding relation.

BRIEF DESCRIPTION OF THE DRAWINGS

The invention will be further described as to an illustrative embodiment in connection with the attached drawings in which.

FEEDSTOCKS AND THEIR SOLUTIONS

Figure 1:
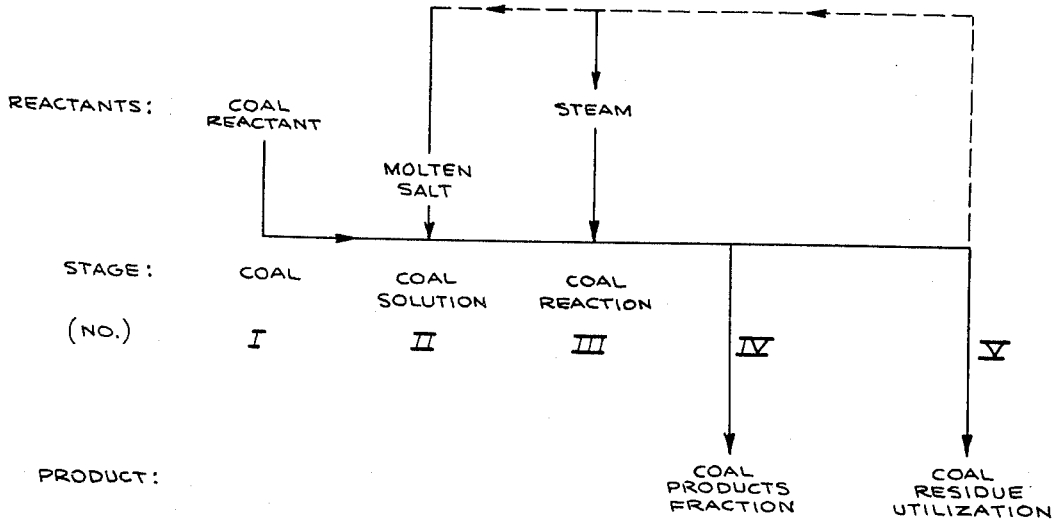
FIG. 1 is a schematic flow sheet of the process showing major operations.

Basic to an understanding of the description to follow is the phenomenon of high molecular weight carbonaceous feedstock solubility in inorganic molten salts. The term "high molecular weight carbonaceous feedstock" herein includes primarily those substances produced by the compaction and degradation of flora over long periods of time as well as fossil counterparts such as heavy tars and petroleum residues. As such these feedstocks are carbon-based or "carbonaceous" and contain more or less hyrodgen, nitrogen, oxygen, and sulfur and various other elements depending on their origin and age and state of decomposition, and are fuels in the sense that they can be oxidized with the release of heat. The term thus includes various "orders" of coal, an index which ranks coals in a series of low to high e.g. lignites, subbituminous, bituminous and anthracite coals as well as the oil derived products just mentioned. It is with the coals of an order below anthracite that the invention will be described and illustrated, but it is to be borne in mind that much of what is taught herein can be applied, with some modification, to oil shale, on the one hand, and on the other hand to carbonaceous solid fuels or waste products having a phyto- antecedent such as cotton, seed hull, and other molecules naturally built of carbon.

DESCRIPTIONS OF THE PREFERRED EMBODIMENTS

COAL STRUCTURE

In the ensuing discussion reference will be to coal as typical and illustrative of the process feedstock or fuel reactant material. Particularly reference is made to the putative structural model of a coal molecule is set out. Industrial and Engineering Chemistry Volume 54, No. 6, June 1962, pages 36–39 by G. Hill and L. Lyon. It will be evident from a consideration of that model that coal is a polymeric material of extraordinary complexity and at the same time an abundant source of numerous carbon chain fragments which if separated substantially intact could be a valuable source of raw materials and fuels. To do this the present invention utilizes milder reaction conditions than convert coal to carbon oxides and char and nonetheless at rapid rates of reaction by ensuring that the reaction mass is a single phase of molten salt solvent and coal polymer solute during hydrogenation. Additionally, the hydrogenation reaction is not carried beyond the point of optimum hydrocarbon production. Thus moderate temperatures and pressures are used and only the relatively reactive portion of the coal molecule is sought to be reacted, freed from the coal polymer complex and thus volatilized, e.g. between 50 and 85% by weight of a typical coad feed is relatively reactive, while the less reactive, more refractory portion of the coal is not attempted to be converted into volatile hydrocarbons, but is kept in solution and burned in a second reactor. This approach of moderation in temperatures and pressure and extent of conversion is nonetheless highly productive of complete coal utilization by virtue of the exceptionally rapid kinetics of solution reaction in contrast to previously known heterogeneous system surface reactions; and withal of relatively greater amounts of gasoline fractions than other coal treating processes. Moreover, the mobility of the complex coal polymer molecule in the salt solution enables ready attack upon the highly reactive sites on the molecule despite twisted and contorted carbon chains throughout the molecule. Further the swelling and dissolution of the coal polymer molecule serves to free trapped contaminants such as minerals and organic sulfur compounds for easy separation at an appropriate point in the process.

PROCESS OVERVIEW

An overview of the process is shown in FIG. 1. For prupose of illustration the reactants are coal, steam and air. The matrix of reaction is molten salt and the products of reaction are a coal products fraction primarily hydrocarbons, and a coal residue which may be used elsewhere, e.g. for heat generation. The process consists broadly in a coal reactant feed stage I with the feed being any of the carbonaceous feedstocks hereinabove mentioned and particularly bituminous and subbituminous coal, a coal solution stage, Stage II, in which the coal feed is mixed with molten salt in a manner effecting solution, such as by admixing in a grinding mixerpump. See FIG. 2.

MOLTEN SALT SYSTEMS

The molten salt is inorganic, ionic and has a melting point within the range of reaction temperatures e.g. between 200° and 500° C. Mixtures of salts may be used, particularly to take advantage of eutectics. An illustrative listing of useful salts and salt mixtures follows:

| | | Melting Point ° C |
|---|---|---|
| KCl | - $BaCl_2$ | 345 |
| " | - $CdCl_2$ | 380 |
| " | - $PbCl_2$ | 411 |
| LiCl | - $PbCl_2$ | 410 |
| " | - $SrCl_2$ | 475 |
| NaCl | - $CdCl_2$ | 397 |
| " | - $CoCl_2$ | 365 |
| " | - $PbCl_2$ | 415 |
| $BaCl_2$ | - $BeCl_2$ | 390 |
| " | - $CdCl_2$ | 450 |
| $CdCl_2$ | - $PbCl_2$ | 387 |
| $ZnCl_2$ | - $SnCl_2$ | 180 |
| " | - $SrCl_2$ | 480 |
| $MgCl_2$ | - $PbCl_2$ | 460 |
| $PbCl_2$ | - $BeCl_2$ | 300 |
| " | - $BiCl_2$ | 205 |
| " | - $CaCl_2$ | 460 |
| " | - $CdCl_2$ | 387 |
| " | - CuCl | 285 |
| " | - $FeCl_3$ | 185 |
| " | - $MnCl_2$ | 405 |
| " | - $PbI_2$ | 310 |
| " | - $SnCl_2$ | 410 |
| " | - TiCl | 390 |
| " | - $ZnCl_2$ | 340 |
| KBr | - LiBr | 310 |
| I | - $CdBr_2$ | 325 |
| I | - $MgBr_2$ | 350 |
| NaBr | - $CdBr_2$ | 370 |
| NaBr | - $MgBr_2$ | 425 |
| PbBr | - $BiBr_2$ | 200 |
| " | - $CdBr_2$ | 344 |
| " | - $HgBr_2$ | 208 |
| " | - $PbCl_2$ | 425 |
| " | - $PbF_2$ | 350 |
| " | - PbI | 282 |

It will be observed that typical salts are halides e.g. fluorides, chlorides, iodides and bromides of alkali, alkaline earth, Group II, Group IV, Group V, Group VII and Group VIII metals particularly potassium, lithium, sodium, beryllium, barium, cadmium, zinc, calcium, lead, strontium, cobalt, bismuth, tin, copper, iron, titanium, manganese, mercury, and magnesium. Additionally, the hydroxides and carbonates of alkali metals, being precursors of their salts, may be used, alone or in admixture with the aforementioned salts or others having appropriate melting points.

Hydrotrating

The coal in molten salt is hydrotreated with steam in Stage III, and because the reaction is effected in the melt solution, pressure is not narrowly critical but moderate superatmospheric pressure is desirable particularly to facilitate treatment of reaction products and therefore pressures of 1 to 25 atmospheres may be used with pressures of 1 to 10 atmospheres being preferred to optimally control volatilization.

While not wishing to be bound to any particular theory of operation, it is believed that within the reactor Stage III molten salt-dissolved coal is hydrocracked by forcing steam into solution in the molten salt which has swollen and solvated the coal polymer network. This severely strains the cross-linking —0 —and —S —bonds between the two-dimensinal layers of the polymer and between adjacent relatively stable aromatic structures within the layers. The steam dissociates in the ionic, inorganic and therefore highly polar salt, becomes highly reactive, producing active, non-molecular hydrogen which attacks and effectively splits the highly strained bonds. This reaction may be summarized as $$\text{Coal} + H_2O \xrightarrow[\Delta]{\text{salt}} CO_2 + \text{HC (gas + liquid) b.p.} < 300^\circ\text{ C}$$
$$+ H_2S + \text{polycyclic aromatics (b.p.} > 300^\circ\text{ C)}$$
$$+ \text{Ash (minerals)}$$

The ash and $H_2S$ may be removed by conventional technology; the hydrocarbon coal products fraction is further processed to obtain the desired hydrocarbons in Stage IV of the process, while the low volatility polyaromatics still in molten salt solution are passed to Stage V for appropriate utilization. The molten salt is purged of the coal residue and may be returned to Stage II for reuse, along the dotted line as shown.

Detailed Process Description

Hydrotreating Process – Stages I – III

Figure 2:
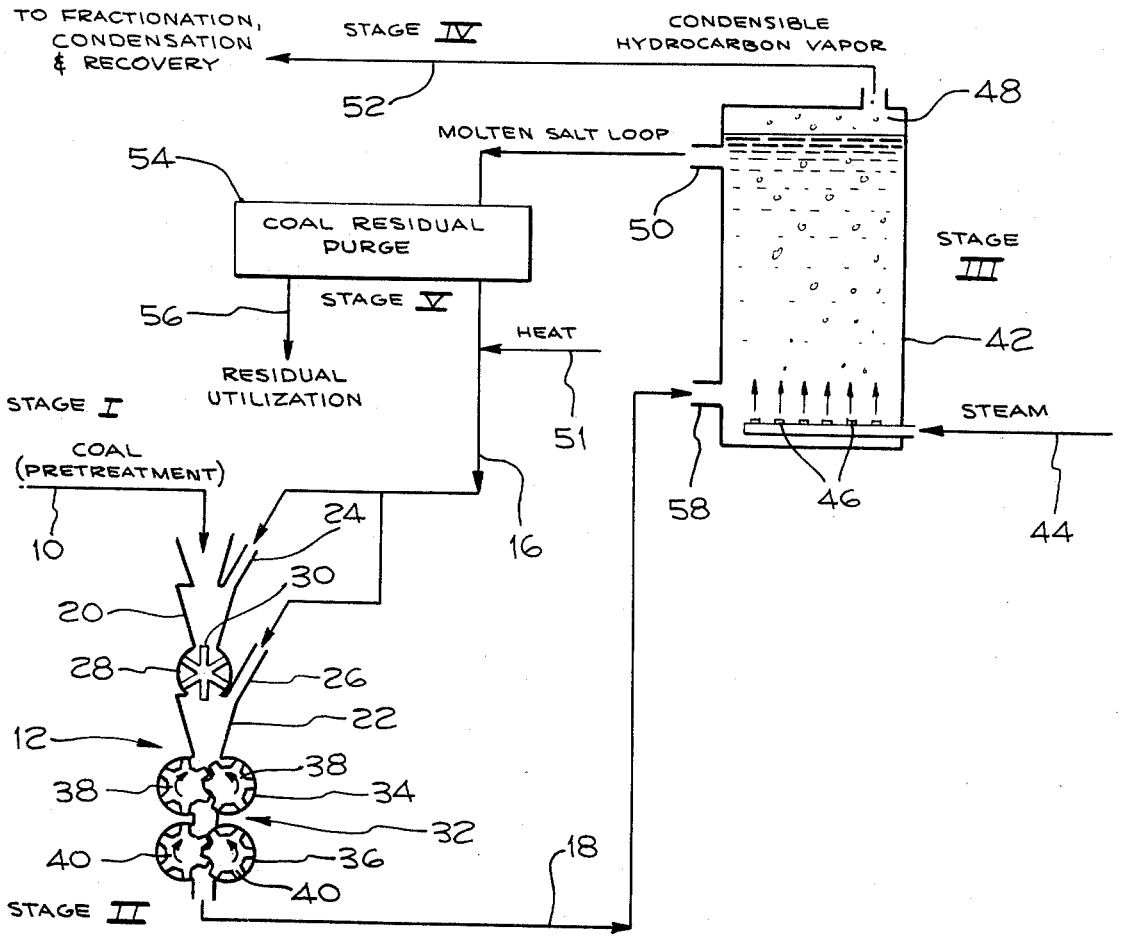
FIG. 2 is a more detailed schematic of the process.

With reference now particularly to FIG. 2, in Stage I coal or other carbonaceous fuel reactant is introduced at line 10 from a conveyor and preliminary sizing (pretreatment) system not shown in detail and together with special purpose additives if any is passed to Stage II, a hopper-feeder solubilizing arrangement generally indicated at 12 wherein the coal and molten salt received from the molten salt loop, line 16, are intermixed with adequate shear, interdispersed and pumped as a solution-slurry homogenate to Stage III along line 18. The hopper-solubilizer 12 comprises a two-stage pump having a first and second funnel inlets 20, 22 each provided with a side inlet 24, 26 for molten salt being returned through molten salt loop 16. Funnel 20 leads to metering and sealing pump chamber 28 within which paddle 30 rotates, its blades in sealing engagement with the chamber 28 wall to meter the salt and fuel reactant into second funnel 22, while sealing the second funnel from the first. Additional molten salt is added through side inlet 26 e.g. to a concentration of 5 to 30% by weight fuel reactant in the salt, which is at a temperature typically of 250° to 600° C maximum. Importantly, the temperature at which the coal and salt are admixed is below that at which outgassing occurs. Heretofore surface gas formation in coal-salt processes has limited solubilization of the coal. In the present process solubilization is carried out in the substantial absence of outgassing. From funnel 22 the mixture enters a shearing-mixing apparatus 32 comprising a two stage pump, each stage 34, 36 comprising interfitting pairs of toothed rotors 38, 40 which grind and admix into solution the coal or other fuel reactant in the salt. The solution is passed along line 18 to reactor 42.

Stage III comprises the hydrotreating reactor 42 wherein steam in line 44 is distributively introduced into the cracking or hydrotreating reactor 42 by nozzles 46 for flow concurrently with the salt solution through the reactor. As the steam is brought to the salt temperature in contact with the ionic material the steam dissociates into active, monmolecular hydrogen which in contact with the fuel reactant under the catalytic effect of the salt hydrogenates the fuel reactant causing formation and evolution of hydrocarbons e.g. from the approximately 50 to 85% of the coal molecules which is volatile under conditions within reactor 42. These evolved hydrocarbons are insoluble in the salt and form bubbles which traverse the salt matrix and which coalesce and gather in the reactor head space 48, while the salt passed off laterally through port 50 into loop 16.

Hydrotreating Theory

It may be mentioned here that polymeric coal while predominantly an aromatic ring structure cross-linked with carbon-carbon bonds, contains as well cross-linkages through oxygen atoms, and sulfur atoms, sulfide, disulfide and hydrogen links. Randomly disposed throughout the loose polymeric network by adsorption, entrapment, or solution or covalent bonding forces are quantities or widely varying low molecular weight materials including methane and homologous aliphatic hydrocarbons. During heretofore known and conventional coking processes, which are carried out at 900°to 1000° C, pyrolysis takes place giving pyrolysis products which consist generally of low molecular weight gases and aromatic ring compounds; the relatively long chain aliphatic molecular fractions which might have been side chains or entrapped in the interstices of the coal structure (being thermally less stable than the aromatic rings) become pyrolyzed i.e. cracked to smaller molecules, or cyclicized to the more stable aromatic ring structures. The initial presence of appreciable quantities of aliphatic hydrocarbons can be demonstrated by the distillation of coal at less than 600° C whereby an appreciable product fraction distilled comprises aliphatics. See, for example, Richter Textbook of Organic Chemistry, p. 446 (1938, published by John Wiley and Sons.) Recent efforts to obtain liquid hydrocarbon from coal have been premised upon solvent extraction and/or hydrogenation wherein as great a percentage as possible of the coal reactant is dissolved in a polycyclic aromatic e.g. anthracene oil, tetralin and the like or a hydrogenated derivative thereof. Upon or during extraction of the aliphatics the molecules are hydrogenated at very high pressures of hydrogen e.g. 50 to 300 atmospheres, which is very costly.

By contrast in reactor 42, according to the present process, dissolution of coal is effected in molten salt at temperatures far below coking temperature. Again without wishing to be bound to a particular theory it is believed that the very high ionization intensity of the molten salt electrical field acts to destabilize the resonating aromatic ring structures facilitating their fragmentation. Then when the steam is introduced into the sytem it dissociates into active moieties including H and OH as well as active nonionic, non molecular hydrogen which may be represented as H*. The destablized ring fragments are of course highly susceptible to addition and/or cleavage reactions with the active moieties from the dissociated steam. This produces a high yield of mid-range molecular weight aliphatic hydrocarbons e.g. $C_6$ to $C_{14}$ and mixed carbon oxides each of which have lower solubility in the molten salt matrix than the aromatic compounds and steam. Note, for example, U.S. Pat. No. 2,768,935 to Watkins in respect of insignificant solubility of volatilized hydrocarbons in molten salts under hydrogenation conditions and substantial pressure. The resulting preferential ejection of the lower solubility product drives the hydrogenation reaction quickly to completion. The reaction of Stage III requires a certain minimum heat content in the salt and this is maintained as necessary by heating the salt by means not shown. It is contemplated, therefore, in the present process that Stage III be conducted as an adiabatic reaction with the only heat input being derived from the heat content of the salt matrix. Necessary heat may be added to the salt at 51.

Hydrocarbon Product Stream Treatment - Stage IV

It is appropriate here to consider the recovery of hydrocarbons generated in Stage III, reactor 42. With reference to FIG. 2 the coal products fraction, comprising essentially the hydrocarbons and carbon oxides generated in reactor 42, is passed along line 52. The contents of line 52 are essentially the volatiles from reactor 42, and they are obtained at temperatures between about 300° and 500° C with 400° C being typical, and at pressures of e.g. 3to 10 atmospheres. These gases may be shift-reacted to increase hydrogen and $CO_2$contents for use as synethesis gas and/or passed to a recovery zone referred to broadly as Stage IV wherein by water cooling and fractionation the several hydrocarbons are separated and recovered. By way of illustration only the hydrocarbon vapors may be expanded through a turbo-expander, releasing heat energy and rapidly cooling and ultimately condensing when the hydrocarbons are normally liquid $C_6$+. It is of course desirable if an expander is used or otherwise to condense and fractionate the hydrocarbon products by molecular weight, e.g. in an expander to expand the vapors progressively to sequentially condense out and separate the several fractions. The hydrocarbons product fraction may be recovered in several stages from a condensation-fractionation zone, e.g. heavy ends $C_{10}$–$C_{20}$, mid-range hydrocarbons, $C_6$–$C_{14}$and an aqueous liquor containing heteroaliphatic, and miscellaneous fractions summarized as R-X in which X may be hydroxyl, nitrogen, sulfur or like hetero atom or group. The lighter ends may be compressed, e.g. with the energy of the turbo-expansion of the vapors, subjected to an acid gas e.g. $H_2S$, separation treatment and further fractionated to remove fixed gases, the desired hydrocarbons $C_1$–$C_6$being separately recovered, all as is known in the art of processing hydrocarbon streams derived from natural feedstocks.

Reaction Parameters

As noted above, the contact of dissociated steam derived hydrogen with the dissolved reactant fuel is brief and effected at moderate temperatures. Within the reactor 42 residence times for the reaction mass are less than 10 seconds, e.g. at minimum reaction temperatures of about 250° C and at higher temperatures residence times are commensurately reduced to e.g. 0.2 to 5 seconds at about 500° C and less up to maximum reaction temperatures of 600° C. Brief contact is realized by rapidly passing the molten salt-fuel reactant solution through the reactor 42. This rate of throughput, the mass effect inherent in having not less than twice the amount of salt as of fuel reactant feedstock and preferably a concentration of about 5% to 30% by weight of feedstock in the salt and the presence desirably of saturation quantities of steam, contribute to a mild hydrogenating condition in the reactor, but a high rate of hydrogenation by virtue of the catalytic effect of the salt and the ultimately subdivided (dissolved) state of the feedstock.

Reactor Parameters

The specific design of the reactor is not normally critical but certain designs are more favorable, and these will be described hereinafter. Primary among the requisites of a preferred form of reactor is the capability of receiving great quantities of molten salt solution over a brief time span i.e. at a high rate and the ability to keep the incoming solution moving more or less colinearly through the reactor so that the process reaction proceeds in a generally progressive way through the reactor. One form of suitable apparatus has been depicted schematically. This reactor 42 is a vertically elongated vessel having at the bottom a molten salt inlet port 58, a molten salt outlet port 50 at the top and just below the plane of the salt inlet part a series of nozzles 46 which deliver steam from line 44 distributively into the upwardly moving salt solution, in such manner that the steam and its dissociation products move concurrently upward through the reaction zone.

Another preferred form of reactor will be described below in conjuction with FIGS. 3 and 4.

Hydrocarbon Vapor Evolution, Passage and Collection

As explained above, the hydrogenation reaction occurring within the reaction zone is productive of hydrocarbon vapor, and other fixed gases. In a progressive continuous flow reactor of the type shown at 42 in FIG. 2 and as will be described in connection with FIGS. 3 and 4, the reaction zone is essentially an extended flow path along which the reaction stream, comprising salt, fuel reactant and active hydrogen, passes. It is the nature of coal and typically of the other feedstocks contemplated for use herein, that the relatively more volatile portions and/or more reactive portions first react followed in sequence by the progressively less volatile and/or less reactive protions thereof. At all times throughout the reaction stream along its extended flow path however, there is initial and continuing evolution of hydrocarbon vapors. Generally the lower molecular weight vapors are first evolved and at the lower end of the reactor 42. Then the somewhat higher molecular weight hydrocarbon vapors are evolved and so forth until, e.g. in the case of bituminous coal from 50 to 85% of the feedstock has been volatilized. As pointed out above, the vapors produced are insoluble in the molten salt. This insolubility coupled with their relatively low molecular weight and high vapor pressure causes a rapid ejection of the vapors from the salt matrix e.g. into the headspace 48 of reactor 42. The rapid ejection of hydrocarbon vapor accelerates the hydrogenation reaction as the reaction cannot equilibrate within the reaction stream. Control on the reaction zone pressure will modify the rate of hydrocarbon vapor ejection and thus enable control of the rate of hydrogenation reaction. As noted, moderate pressures in the range of 1 to 25 atmospheres particularly 1 to 10 atmospheres and in some particularly preferred cases 3 to 10 atmospheres are the desired pressure conditions within the reactor.

Returning to the evolved hydrocarbon vapors it is a signal feature of the process that these vapors pass differentially through the reaction stream mass, i.e. the vapors move relatively faster than and therefore through the reaction stream ahead of them in the reactor, and moreover that these vapors move differentially responsive to molecular weight differences so that the lighter evolved vapors typically first evolved as mentioned move more rapidly through the molten salt matrix of the reaction stream, more swiftly than the heavier, typically later evolved vapors, catching up with and combining or coalescing with these higher weight vapors, in a scrubbing or stripping action which assists removal from the reaction stream of the heavier and more sluggish vapor fractions and thus accelerating even the terminal portions of the reaction.

In order to achieve this scrubbing action, the reaction zone and reactant stream passage therethrough are designed with the outlet for the hydrocarbon vapors opposite the reaction stream inception point, e.g. typically at a head space in a vertical reactor in which the reactant stream passes upwardly, and in a center area of a circular reactor as will now be described.

Discoid Reactor and Reaction Therein

Figure 3:
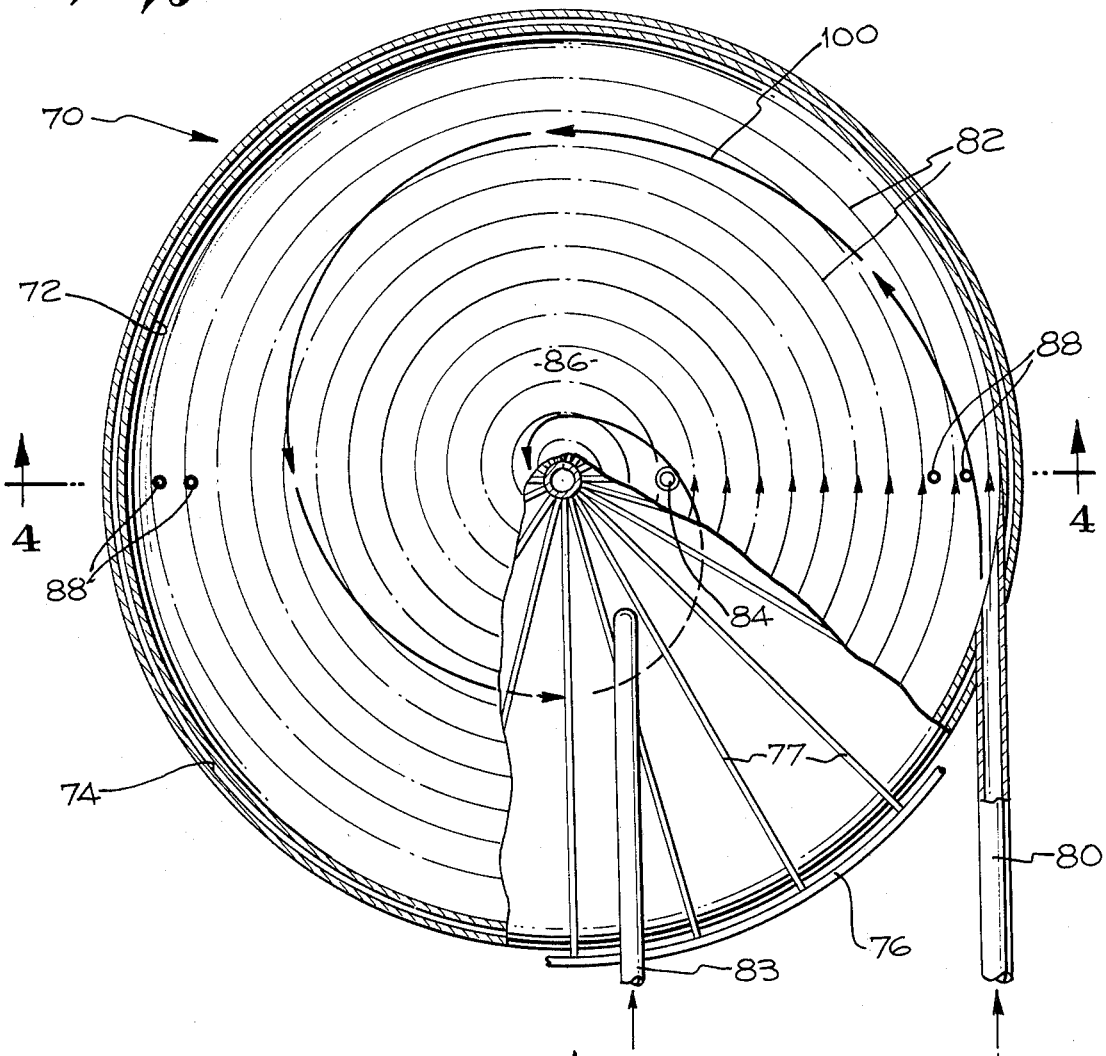
FIG. 3 is a plan view, partly broken away to show underlying parts of a discoid reactor according to the invention.
Figure 4:
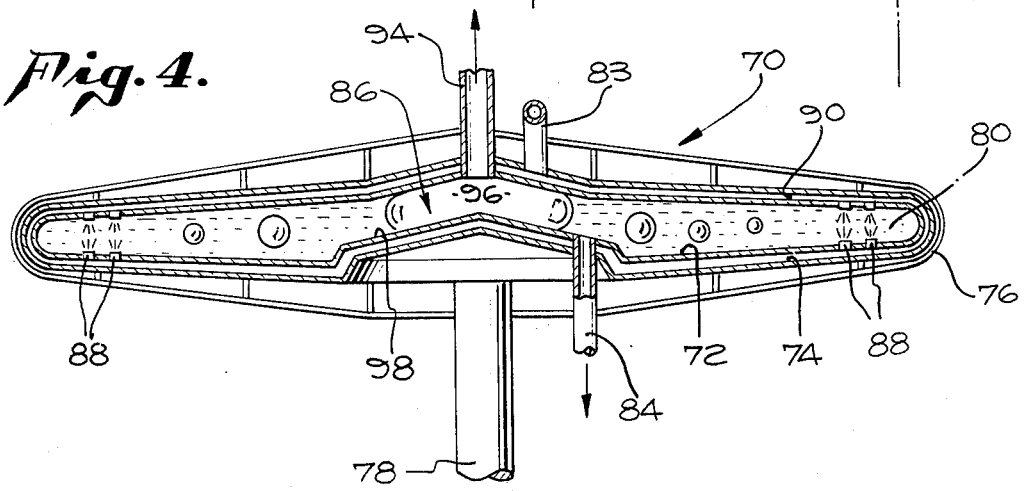
FIG. 4 is a view in vertical section thereof, taken on line 4—4 in FIG. 3.

Referring now to FIGS. 3 and 4, a discoid reactor 70 is shown in which reaction stream lines move spirally in laminar relation from the periphery to the center of the reactor with the passage of hydrocarbon vapor being also spiral and at a greater pitch than the reaction stream lines to move to and across steam line interfaces scrubbing or stripping the later evolved vapors as in the vertical reactor 42 above described, but horizontally. For this purpose, the reactor 70 comprises a reaction chamber 72 of metal resistant to the high temperatures envisioned, a second chamber 74 enclosing the reactor chamber and defining a steam jacket for purposes to appear and an open frame structure including a circular member 76 and plural radially disposed ribs 77 above and below the chambers 72, 74 in supporting relation, the entire structure being conveniently supported on a pedestal 78. As best shown in FIG. 3, molten salt solution prepared as in Stages I and II in FIG. 2, is introduced into the reactor chamber 72 tangentially through inlet pipe 80 which is lead through the steam jacket chamber 74. The salt solution owing to the circular shape of the reactor 72 moves circularly at first and then inwardly progressively forming a spirally moving mass 82 of molten salt and fuel reactant. An outlet for the salt is provided at 84 being a simple downpipe communicating the reactor 72 intermediate the central portion 86 with the outside of the reactor. Inboard of the salt inlet a series of jets 88 for the introduction of steam into the moving salt is provided, circularly spaced and in number as necessary to incorporate the needed quantity of steam into the salt solution to form the reaction stream as a series of stream lines 82 saturated with dissociating steam and providing the required brief contact between active hydrogen and dissolved feedstock.

The steam introduced at jets 88 is desirably passed over the reactor 72 exterior surface 90 for prewarming as necessary and more importantly to absorb heat emanated from the reactor 72 and thereby protect the support structure 76, 77 from undue heat exposure, thus enabling the use of relatively lower cost materials in construction of the support structure than might otherwise be practicable, given the multi-hundred degree centigrade reaction condition. For this purpose the steam is introduced into the outer or second chamber 74 at 83 approximately the center of the chamber and passed through the chamber and outwardly across the reactor surface 90 to the peripherally located jets 88.

Vapors generated in the reactor 72 are as in the vertical reactor 42 embodiment moved through the salt matrix differentially with respect to the salt and with respect to each other depending on molecular weight as explained. These vapors move toward the reactor center 86 and outlet pipe 94 located there, i.e. opposite the inlet as in the vertical reactor 42 embodiment.

There are additional considerations, however, in the spiral reactor. It is evident that in either the vertical reaction zone or the discoid reaction zone there will be some tendency for the hydrocarbon vapors to become entrained in the salt matrix. In the vertical reactor these forces are concurrent, both the vapor and the salt are moving upward. In the horizontal or discoid reaction zone the path of the hydrocarbon vapor is a vector of entrainment and other forces acting on the individual bubbles of produced hydrocarbon. That is, the salt moving in a spiral tends to carry the bubbles along in the reaction stream. Nonetheless, the vapor outlet is at the reactor center 86 and the lowest pressure is found there giving the hydrocarbon vapor a radial inward bias. Additionally the salt is moving at a high angular velocity and centrifugal forces will tend to urge the salt outward and thus the vapor bubbles which have far less density less so and thus tend to relatively displace the bubbles inward toward the reactor center 86. To facilitate separation of vapor and substantially exclude salt from the vapor outlet 94 the reactor 86 has a central domed area 96 communicating with the outlet pipe, and a correspondingly raised interior bottom wall 98 thereopposite which serves to define area 96 as a vapor space.

As in the vertical reactor embodiment, the hydrocarbon vapors typically those which are relatively light are first generated near the steam-salt solution mixing at jets 88, and hydrocarbons, generally progressively heavier, are continuously generated as the reaction streams progress spirally through the reactor 72. The evolved hydrocarbons move more rapidly than the salt and through the coaction of the forces mentioned move to and across the stream line interfaces in a greater pitch spiral path shown illustratively at 100 in FIG. 3. This movement through the several stream lines provides the stripping or scrubbing action hereinabove described wherein lighter earlier evolved vapors contact coalesce with and carry with them later evolved heavier hydrocarbons as their flow paths intersect, accelerating the hydrogenation reaction through ejection of the product vapors.

Example

A molten salt system comprising mixed lithium, sodium, potassium and magnesium chlorides and heated to a molten condition at between 375° and 400° C is circulated in loop 16 of the system shown in FIG. 2. Coal of the bituminous type suitably prepulverized is introduced at Stage I through line 10 via conveyor and weight feeder metering combination (not shown) and admixed with the molten salt in Stage II wherein the coal is further comminuted in salt admixture until solubilized into a single phase homogenate, whence it is passed along line 18 to hydrotreating reactor 42.

In the hydrotreating reactor 42, the dissolved coal is hydrocracked by molten salt dissolved and dissociated steam to a collection of volatile hydrocarbons, $CO_2$and a low hydrogen, polynucleated aromatic residual which remains in solution. The volatile hydrocarbons (synthetic petroleum) overheads are delivered via line 52 to Stage IV for fractionation, removal of sulfur, and the separation of high calorie line gases, LPG, naphthas, gasolines, kerosine and diesel fuel ranges and clean fuel oil products. The molten salt solution of the coal residuals is passed via line 16 to Stage V, a purge zone 54, where the coal residual may be burned or otherwise removed from the recirculating salt and passed e.g. through line 56.

I claim:

1. Apparatus for the conversion of coal and like high molecular weight feedstocks at least partially to hydrocarbon vapor which comprises a reaction chamber having a central portion, an outer periphery, and a generally circular horizontal cross-section therebetween, means introducing a molten salt solution of said feedstock tangentially into said chamber at its outer periphery, said chamber being shaped to guide said feedstock solution circularly then inwardly progressively as a spirally moving mass from said chamber outer periphery toward the chamber central portion, a circularly distributed series of jet means outward of the chamber central portion, said jet means mixing steam continually distributively into fresh portions of said salt solution to form said moving mass of feedstock solution in molten salt into a reaction stream and under hydrogenating conditions within the chamber, whereby hydrocarbon vapors are evolved in the reaction stream in spirally moving reaction stream-entrained relation, vapor recovery means recovering evolved hydrocarbon vapors from said molten salt comprisng a central domed portion in the reactor and a vapor outlet in said portion at a relative pressure to radially inwardly bias movement of said evolved hydrocarbon vapor toward said outlet through the spirally moving reaction stream, and molten salt recovery means including a reaction chamber salt outlet in the chamber central portion.

2. Apparatus according to claim 1 in which said chamber central portion includes a bottom wall raised relative to the chamber outer periphery in vapor space defining relation for said evolved vapors.

3. Apparatus according to claim 2 including also an insulating jacket enclosing said chamber, said jacket defining a path over the chamber exterior surface toward said jet means for the steam to be introduced into said chamber by said jet means.

4. Apparatus according to claim 3 including also support structure for said chamber including plural radially disposed ribs, said insulating jacket and ribs being arranged relatively to insulate the ribs from the heat within said chamber.

* * * * *